US009377740B2

(12) United States Patent
Saito et al.

(10) Patent No.: US 9,377,740 B2
(45) Date of Patent: Jun. 28, 2016

(54) IMAGE FORMING APPARATUS SUPPLYING TONER BASED ON TONER DENSITY OF DEVELOPER CONTAINED IN CONTAINING UNIT AND METHOD FOR CONTROLLING IMAGE FORMING APPARATUS

(71) Applicant: CANON KABUSHIKI KAISHA, Tokyo (JP)

(72) Inventors: Fumiyoshi Saito, Toride (JP); Yusuke Ishida, Toride (JP); Naoki Mugita, Toride (JP); Katsuya Nose, Matsudo (JP); Toshihisa Yago, Toride (JP); Kosuke Takeuchi, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/566,617

(22) Filed: Dec. 10, 2014

(65) Prior Publication Data

US 2015/0168868 A1 Jun. 18, 2015

(30) Foreign Application Priority Data

Dec. 17, 2013 (JP) ..... 2013-260379

(51) Int. Cl.
*G03G 15/08* (2006.01)
*G03G 15/00* (2006.01)

(52) U.S. Cl.
CPC ..... *G03G 15/556* (2013.01); *G03G 15/0877* (2013.01); *G03G 15/0829* (2013.01); *G03G 2215/00029* (2013.01)

(58) Field of Classification Search
CPC ..... G03G 15/556; G03G 15/0877; G03G 15/0829; G03G 2215/00029; G03G 2215/0888
USPC ..... 399/27, 30, 61, 62
See application file for complete search history.

(56) References Cited

U.S. PATENT DOCUMENTS

| | | | | |
|---|---|---|---|---|
| 7,395,002 | B2 * | 7/2008 | Funayama | G03G 15/5041 399/44 |
| 7,450,867 | B2 * | 11/2008 | Itoyama | G03G 15/0853 399/258 |
| 2013/0202319 | A1 | 8/2013 | Komatsu et al. | |
| 2015/0168867 | A1 * | 6/2015 | Shirakata | G03G 15/0824 399/27 |

FOREIGN PATENT DOCUMENTS

| | | | |
|---|---|---|---|
| JP | 2006133535 | A * | 5/2006 |
| JP | 2008-065054 | A | 3/2008 |

(Continued)

*Primary Examiner* — Robert Beatty
(74) *Attorney, Agent, or Firm* — Canon USA, Inc. IP Division

(57) ABSTRACT

An image forming apparatus includes an image forming unit including a containing unit that contains a developer including toner and forms an image based on image data by using the toner, a supply unit that supplies the toner into the containing unit, a consumption amount calculation unit that calculates, based on information related to a density of an image corresponding to the image data, a consumption amount in the containing unit, a detection unit that detects a toner density of the developer in the containing unit, a correction amount calculation unit that calculates, based on the information and the toner density detected by the detection unit, a correction amount by which the consumption amount is corrected, and a controller that controls the supply unit based on the consumption amount and the correction amount calculated by the correction amount calculation unit.

18 Claims, 11 Drawing Sheets

(56) References Cited

FOREIGN PATENT DOCUMENTS

JP 2009276517 A * 11/2009
JP 2010072305 A * 4/2010
JP 2012242425 A * 12/2012

* cited by examiner

IMAGE FORMING APPARATUS SUPPLYING TONER BASED ON TONER DENSITY OF DEVELOPER CONTAINED IN CONTAINING UNIT AND METHOD FOR CONTROLLING IMAGE FORMING APPARATUS

BACKGROUND

1. Field

Aspects of the present invention generally relate to a toner supply control processing of supplying toner into a containing unit.

2. Description of the Related Art

Electrophotographic image forming apparatuses consume toner contained in a containing unit to form a toner image based on image data input to the image forming apparatus.

It has been known that in the image forming apparatus, a density of a developed image (toner image) changes in accordance with a ratio [wt %] (hereinafter, referred to as toner density) of toner in a developer contained in a containing unit. Thus, the image forming apparatus needs to supply toner into the containing unit from a container, so that the toner density of the toner contained in the containing unit remains a target density (target ratio [wt %]).

A conventionally known image forming apparatus determines a toner supply amount based on an amount (consumption amount) of toner in the containing unit, and a difference between the toner density of the toner and a target density. An image forming apparatus discussed in US2013/0202319 determines the toner supply amount based on the estimated consumption amount of the toner based on image data, the difference between the toner density of the toner contained in the containing unit and the target density, and a cumulative value of the difference.

The estimated consumption amount of the toner obtained by a calculation is only theoretical, and thus is slightly different from the actual consumption amount of the toner in the containing unit. Moreover, the amount of toner, supplied to the containing unit from the container, is inaccurate. Thus, the toner density of the toner in the containing unit might not reach the target density even when the toner is supplied to the containing unit, based on the toner supply amount determined as described above. Thus, in US2013/0202319, a correction amount, by which the toner density of the toner is corrected, is determined to achieve the target density based on a difference between the toner density of the toner and the target density. Then, the toner supply amount is determined by adding the correction amount to the consumption amount.

However, the image forming apparatus discussed in US2013/0202319 has a problem when an amount of toner in the containing unit is larger than a target amount. The problem occurs when a plurality of toner images requiring a large toner consumption is formed after a plurality of toner images requiring only a small toner consumption is formed. Specifically, the toner is not swiftly supplied to the containing unit after the toner image requiring a large toner consumption has started to be formed.

A correction amount, calculated while the toner images requiring only a small toner consumption are formed in the state where the amount of toner in the containing unit is larger than the target amount, is value that reduces the supply amount of the toner. Specifically, the cumulative value of the difference between the toner density and the target density, involved in the calculation of the correction amount, is value by which the supply amount of toner is reduced.

Thus, when the toner image requiring a large toner consumption is formed after a plurality of toner images requiring only a small toner consumption is formed, the correction amount by which the supply of toner is reduced might exceed the toner consumption amount estimated with respect to the toner image requiring a large toner consumption. As a result, the toner is not supplied to the containing unit, even though the toner in the containing unit is decreasing because the toner image requiring a large toner consumption, has started to form.

SUMMARY

An image forming apparatus according to an aspect of the present invention includes an image forming unit including a containing unit configured to contain a developer including toner, and configured to form an image based on image data by using the toner contained in the containing unit, a supply unit configured to supply the toner into the containing unit, a consumption amount calculation unit configured to calculate, based on information related to a density of an image corresponding to the image data, a consumption amount of the toner consumed in the containing unit in a case where the image forming unit forms the image, a detection unit configured to detect a toner density of the developer contained in the containing unit, a correction amount calculation unit configured to calculate, based on the information related to the density of the image corresponding to the image data and the toner density detected by the detection unit, a correction amount by which the consumption amount calculated by the consumption amount calculation unit is corrected, and a controller configured to control the supply unit based on the consumption amount calculated by the consumption amount calculation unit and the correction amount calculated by the correction amount calculation unit.

Further features of the present disclosure will become apparent from the following description of exemplary embodiments with reference to the attached drawings.

DESCRIPTION OF THE EMBODIMENTS

Various exemplary embodiments will be described in detail below with reference to the drawings.

(Image Forming Apparatus)

Figure 1:
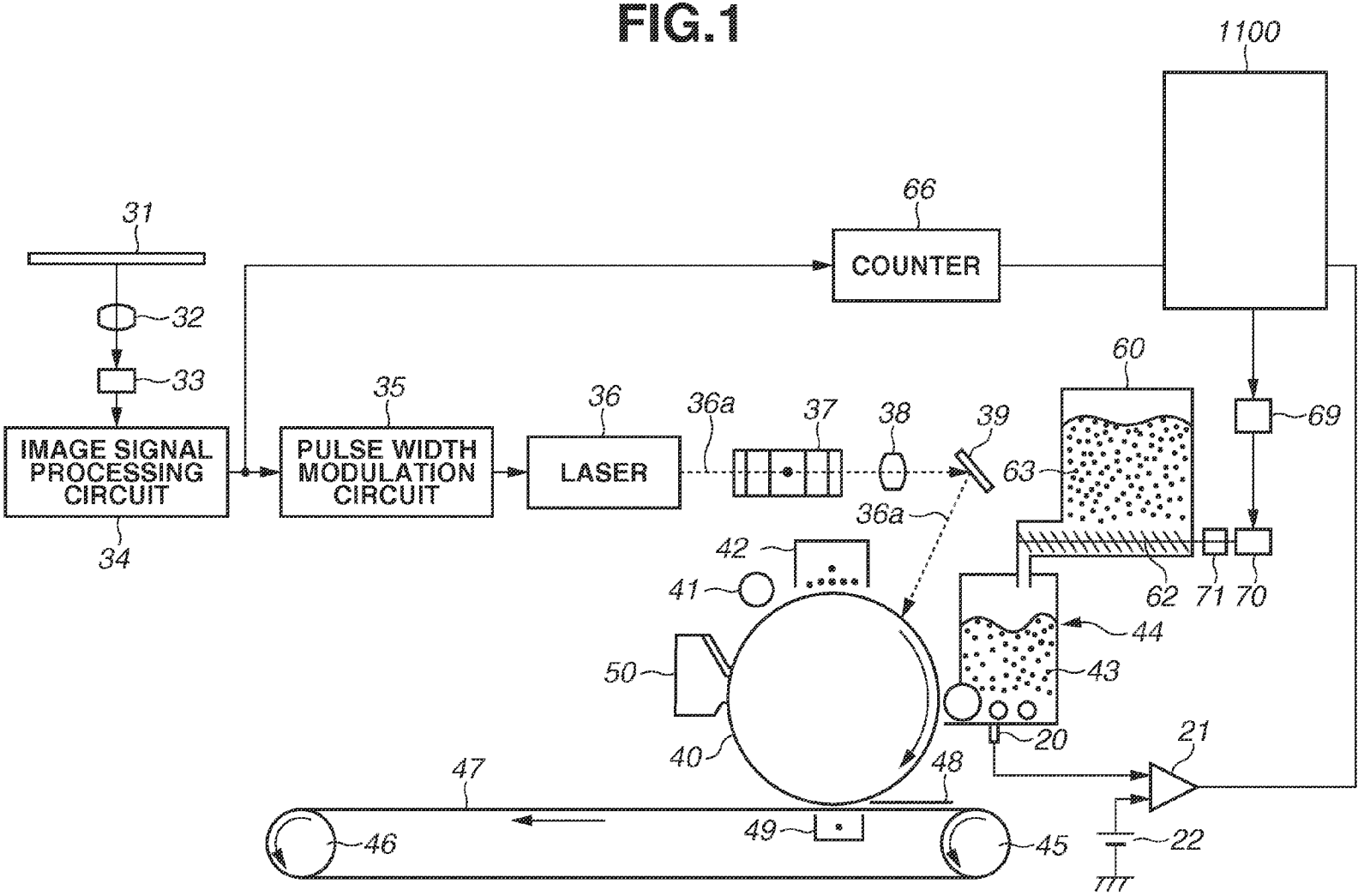
FIG. 1 is a schematic configuration view of an image forming apparatus.

A first exemplary embodiment is described below. FIG. 1 is a schematic configuration diagram of an image forming apparatus. In FIG. 1, an image of a document 31 is read by a reader in the following manner. Specifically, the reader irradiates the document 31 with light, and, with use of a lens 32, projects light reflected from the document 31 on an image sensor 33 such as a charge-coupled device (CCD). The image sensor 33 generates an analog image signal corresponding to the density of the image of the document 31. The analog image signal output from the image sensor 33 is transmitted to an image signal processing circuit 34. In the image signal processing circuit 34, the analog image signal is converted into a digital image signal having an output level corresponding to densities of respective pixels, to be output to a pulse width modulation circuit 35.

The pulse width modulation circuit 35 outputs a pulse signal having a duration (time length) corresponding to the densities of the respective pixels, based on the received digital image signal. The pulse signal output from the pulse width modulation circuit 35 is supplied to a semiconductor laser 36. The semiconductor laser 36 outputs a laser beam 36*a* based on the duration of the pulse signal.

The laser beam 36*a* emitted from the semiconductor laser 36 is deflected by a rotational polygon mirror 37 to be radiated onto a photosensitive drum 40 through a lens 38 such as an f/θ lens and a mirror 39. The photosensitive drum 40 is drivingly rotated in a direction of an arrow in the figure. The rotational polygon mirror 37 rotates in such a manner that the photosensitive drum 40 is scanned with the laser beam 36 deflected by the rotational polygon mirror 37, in a direction (main scanning direction) parallel with a rotational axis of the photosensitive drum 40.

The photosensitive drum 40 is neutralized by a neutralization unit 41, and then is uniformly charged by a charging unit 42. The semiconductor laser 36, the rotational polygon mirror 37, the lens 38, and the mirror 39 form an exposure device. The exposure device exposes the photosensitive drum 40 with the laser beam 36*a* modulated in accordance with the digital image signal. Thus, an electrostatic latent image corresponding to the digital image signal is formed on the photosensitive drum 40. A developing unit 44 is a containing unit that contains a two-component developer 43 including a carrier and toner. The developing unit 44 develops the electrostatic latent image formed on the photosensitive drum 40 by using the toner, to form a toner image. A recording material bearing belt 47 is wound over two rollers 45 and 46, and holds and conveys a recording material 48 in a direction of an arrow in the figure. A transfer charging unit 49 transfers the toner image formed on the photosensitive drum 40 onto the recording material 48 that is held by the recording material bearing belt 47.

The recording material 48, on which the toner image is thus formed, is separated from the recording material bearing belt 47, and conveyed toward an unillustrated fixing unit. The fixing unit includes a heating roller having a heater and a pressing roller that presses the heating roller. The fixing unit applies heat and pressure to the recording material 48, on which the toner image is thus formed, whereby the toner image on the recording material 48 is fixed on the recording material 48. A drum cleaner 50 removes the toner remaining on the photosensitive drum 40 after the toner image on the photosensitive drum 40 has been transferred onto the recording material 48.

In the description above, the image forming apparatus includes a single image forming station formed of the photosensitive drum 40, the neutralization unit 41, the charging unit 42, the developing unit 44, the transfer charging unit 49, and the drum cleaner 50. Alternatively, the image forming apparatus may include a plurality of the image forming stations. For example, four image forming stations respectively corresponding to cyan, magenta, yellow, and black colors may be arranged along the conveyance direction of the recording material bearing belt 47 to form a full-color image forming apparatus. In this configuration, the image on the document 31 is separated into the cyan, magenta, yellow, and black colors. Then, toner images corresponding to the color components of the respective image forming stations are formed on the photosensitive drums 40. Then, the toner images corresponding to the color components of the respective image forming stations are sequentially transferred onto the recording material 48 held on the recording material bearing belt 47, whereby a full-color toner image is formed.

Figure 2:
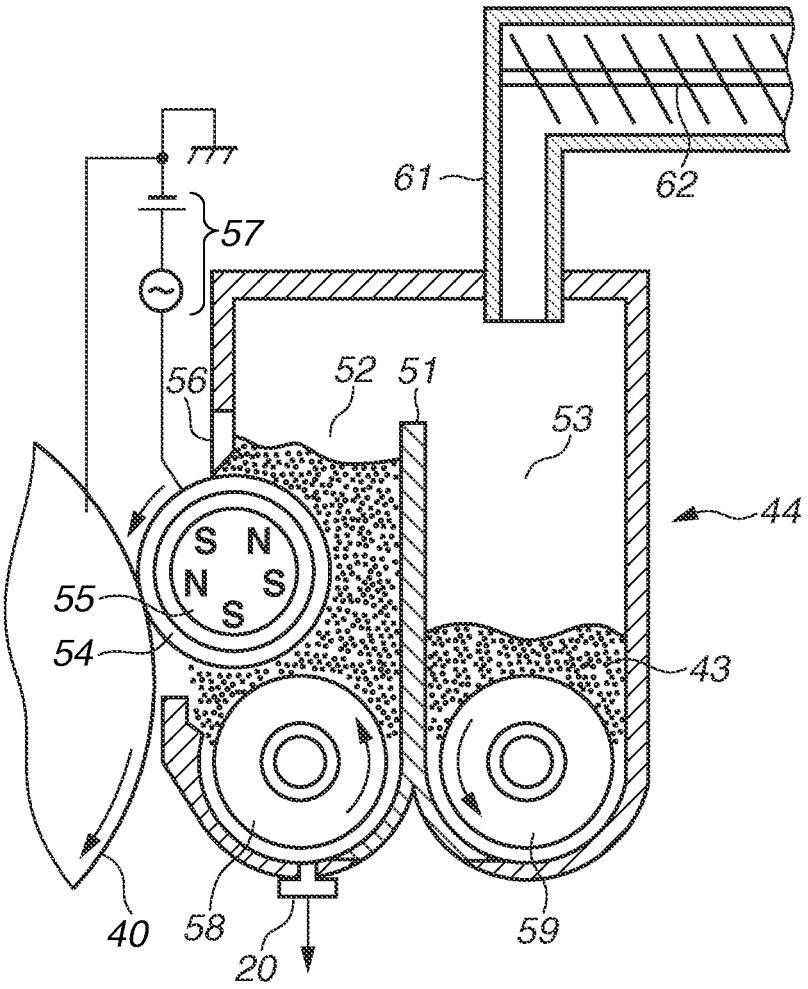
FIG. 2 is a schematic view of a main part of a developing unit provided in the image forming apparatus.

FIG. 2 is a schematic diagram illustrating a main part of the developing unit 44. The developing unit 44 is disposed facing the photosensitive drum 40. A partition wall 51 divides an inner space of the developing unit 44 into a development chamber 52 and an agitation chamber 53. The development chamber 52 incorporates a non-magnetic development sleeve 54 that rotates in a direction of an arrow. A magnet 55 is fixed in the development sleeve 54.

A regulation blade 56 regulates the thickness of a layer of the developer 43 held by the development sleeve 54. The developer 43, held by the development sleeve 54, passes through a development area facing the photosensitive drum 40, to be supplied to the photosensitive drum 40, as the development sleeve 54 rotates in the direction of the arrow. Thus, the electrostatic latent image on the photosensitive drum 40 is developed. A power source 57 applies a voltage to the development sleeve 54. The voltage is obtained by superimposing a direct current (DC) voltage on an alternate current (AC) voltage.

An agitation screw 58 agitates and conveys the developer 43 in the development chamber 52. An agitation screw 59 agitates toner and the developer 43 contained in the agitation chamber 53. Toner 63 is supplied from a hopper 60 (FIG. 1) through a toner discharge port 61 by a rotation of the conveyance screw 62. Thus, a uniform ratio of toner in the developer 43 (hereinafter, referred to as toner density) is achieved. An unillustrated developer path is formed in the partition wall 51. The development chamber 52 and the agitation chamber 53 are in communication with each other through the developer path. Thus, when the agitation screws 58 and 59 rotate, the developer 43 contained in the development chamber 52 and the agitation chamber 53 circulates in the developing unit 44.

An inductor sensor 20 is disposed on a bottom wall of the development chamber 52. The inductor sensor 20 detects the toner density of the developer 43 contained in the developing unit 44. Specifically, the inductor sensor detects magnetic permeability of the developer 43 contained in the development chamber 52, and outputs a signal corresponding to the ratio of toner in the developer 43. A controller 1100 (FIG. 3) detects the ratio of the toner in the developer 43 (in the unit of [wt %]) based on the output signal from the inductor sensor 20.

The developer 43 contained in the development chamber 52 includes the toner and a magnetic carrier. Thus, when the toner density of the developer 43 increases, the ratio of the carrier in the developer 43 decreases, whereby an output value of the inductor sensor 20 decreases. When the toner density of the developer 43 decreases, the ratio of the carrier in the developer 43 increases, whereby the output value of the inductor sensor 20 increases. Thus, the inductor sensor 20 detects the ratio of the toner in the developer 43 accumulated in the development chamber 52, and outputs the signal corresponding to the ratio to the controller 1100 (FIG. 3).

In the present exemplary embodiment, the controller 1100 performs toner supply control processing of supplying the toner into the developing unit 44 from the hopper 60. The processing is based on the image data transmitted from an interface (I/F) unit 504 and the toner density detected by the inductor sensor 20. The toner supply control processing is described below.

Figure 3:
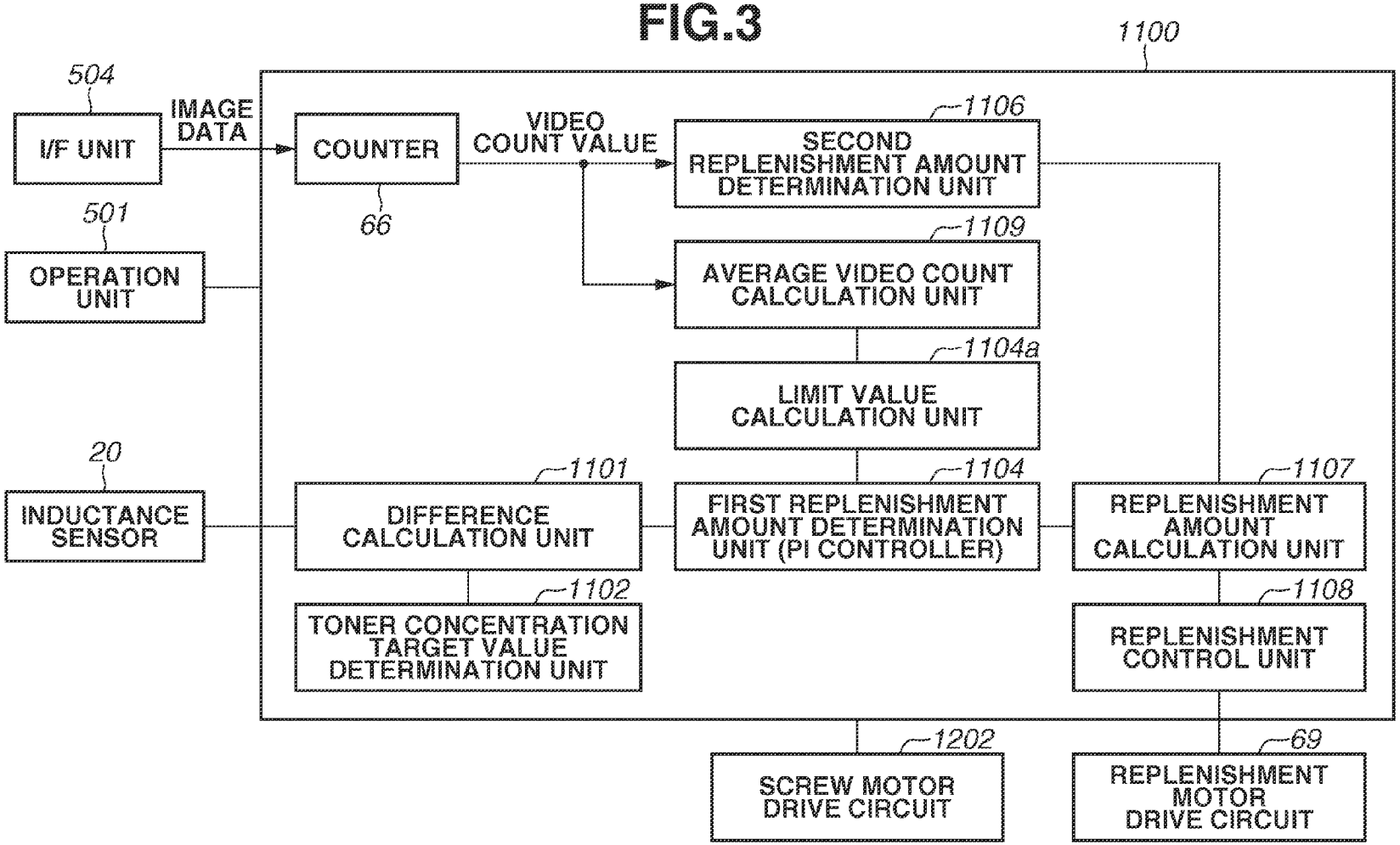
FIG. 3 is a block diagram illustrating an electrical configuration related to toner supply in a first exemplary embodiment.

FIG. 3 is a block diagram illustrating an electrical configuration related to the toner supply in the image forming apparatus. The controller 1100 is a control circuit that controls components to perform the toner supply control processing. For the sake of description, an inner section of the controller 1100 is illustrated with blocks representing functions executed by the controller 1100 in the toner supply control processing.

The inductor sensor 20 is described above based on FIG. 2, and thus will not be described herein. A supply motor drive circuit 69 controls a motor 70 (FIG. 1) that drivingly rotates the conveyance screw 62. A screw motor drive circuit 1202 controls an unillustrated motor that drivingly rotates the agitation screws 58 and 59 (FIG. 1).

An operation unit 501 includes: ten keys for inputting the number of copies, a copying magnification, and the like; a copy button for starting image formation; a setting button for setting the number of copies, and the paper type and the size of the recording material 48; and a liquid crystal display capable of displaying guidance for assisting various operations of the image forming apparatus.

A counter 66 counts the sum (hereinafter, referred to as video count value Vn) of the densities of respective pixels in an image corresponding to a single page, based on the image data input to the controller 1100 through the I/F unit 504. When the toner image is formed based on the document 31, the video count value Vn is counted based on an analog image signal input to the controller 1100 from the image sensor 33. The image data includes the analog image signal.

The video count value Vn counted by the counter corresponds to the amount of toner consumed in the developing unit 44, when the image forming station forms a toner image corresponding to a single page of the recording material 48. Thus, the video count value Vn is information related to the density of the image data. A method for acquiring the video count value Vn is a known technique and thus will not be described.

In the present exemplary embodiment, the controller 1100 determines an amount of the toner 63 to be supplied into the developing unit 44. The determination is based on the output value, output from the inductor sensor 20, and the video count value Vn acquired by the counter 66. The controller 1100 supplies the toner 63 in the hopper 60 (FIG. 1) into the developing unit 44 by causing the supply motor drive circuit 69 to rotate the conveyance screw 62, based on a cumulative value of the determined supply amount.

(Toner Supply Control Processing)

Figure 4:
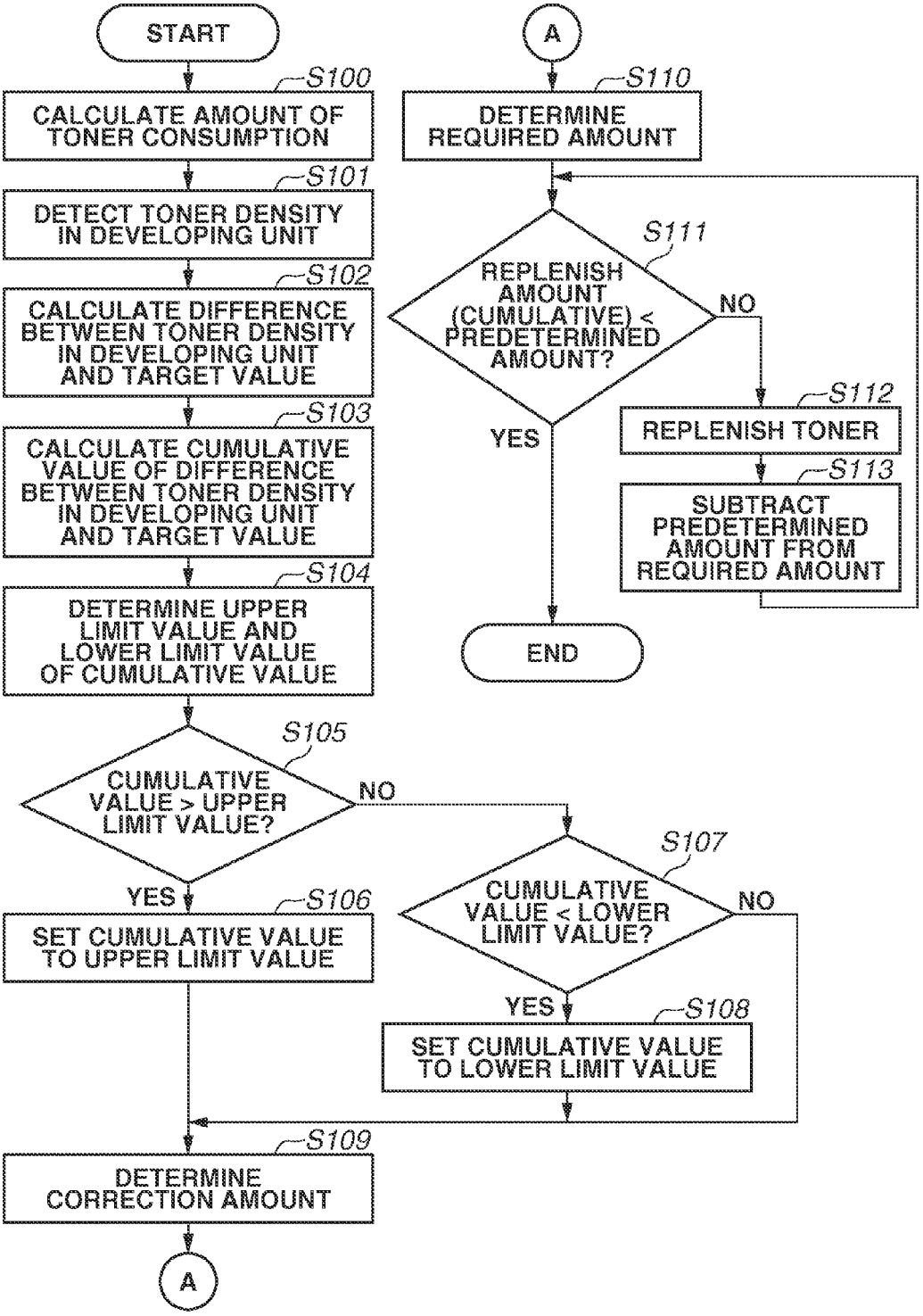
FIG. 4 is a flowchart illustrating toner supply control processing in the first exemplary embodiment.

The toner supply control processing in the present exemplary embodiment is described below based on FIG. 4. FIG. 4 is a flowchart illustrating operations of the controller 1100.

The controller 1100 starts the toner supply control processing when document-based image data, generated by the reader by reading the document 31, is transmitted to the controller 1100. Alternatively, the controller 1100 starts the toner supply control processing when the image data output from an unillustrated personal computer (PC) is transmitted to the controller 1100 through the I/F unit 504. When the image forming station forms an image based on the image data transmitted from the I/F unit 504, the controller 1100 performs the toner supply control processing every time the image corresponding to a single page of the recording material 48 is formed.

Furthermore, a configuration may be employed where the controller 1100 performs the toner supply control processing upon receiving image data from an unillustrated scanner or when the copy button of the operation unit 501 is pressed.

Although not described in the flowchart, the controller 1100 causes the screw motor drive circuit 1202 to drivingly rotate the agitation screws 58 and 59 (FIG. 1), upon receiving the image data.

In step S100, the controller 1100 calculates a toner consumption amount Tv based on the image data. Specifically, in step S100, the counter 66 counts the video count value Vn based on the image data. A second supply amount determination unit 1106 refers to a conversion graph (FIG. 5) to determine the toner consumption amount Tv corresponding to the video count value Vn counted by the counter 66. The conversion graph illustrates the corresponding relationship between the video count value Vn and the toner consumption amount Tv. In step S100, the counter 66 and the second supply amount determination unit 1106 function as a consumption amount calculation unit that calculates the toner consumption amount based on the image data.

Figure 5:
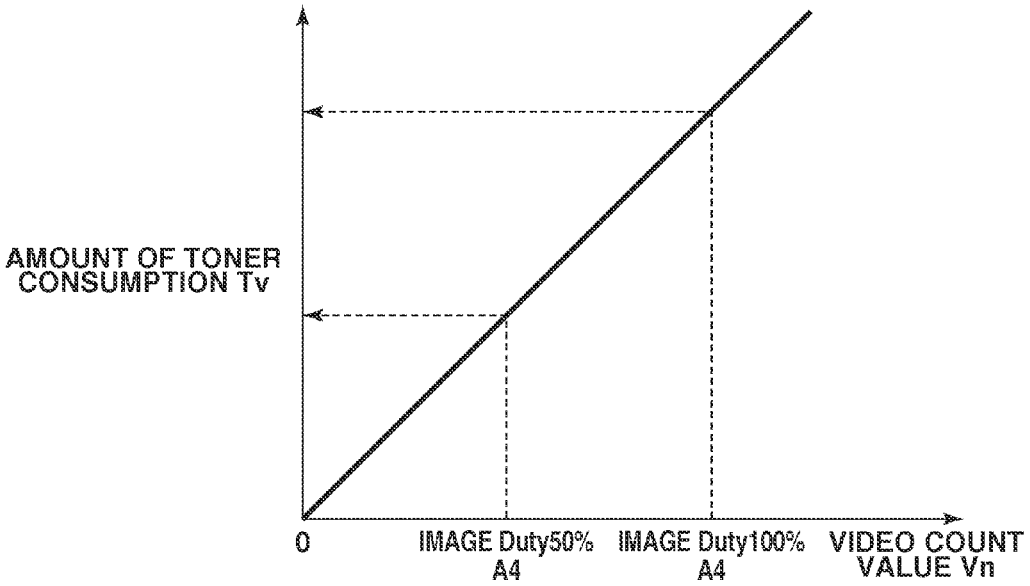
FIG. 5 is an explanatory diagram of a conversion graph between a video count value and a toner consumption amount.

The conversion characteristics of the conversion graph illustrated in FIG. 5 is described. In FIG. 5, the X axis represents the video count value Vn. The video count value Vn is determined under a condition that an image Duty 100 [%] represents a solid toner image formed on a single page of the recording material 48. Thus, in FIG. 5, image duty 100[%] corresponds to the video count value Vn of the solid toner image formed on the recording material 48 of an A4 size. In other words, the video count value Vn is determined by the size of the recording material 48 and a ratio of an area where the toner image is formed, to an area of the recording material 48 where the image can be formed. The conversion graph illustrated in FIG. 5 is stored in a read only memory (ROM) 503 in advance.

The toner supply control processing is further determined by referring back to FIG. 4. In the present exemplary embodiment, the second supply amount determination unit 1106 outputs the toner consumption amount Tv in the developing unit 44 when the toner image corresponding to the a single page of the recording material 48 is formed in the image forming station, based on the transmitted image data.

The counter 66 transmits the video count value Vn counted for each page of the recording material 48 to the second supply amount determination unit 1106 and to an average video count calculation unit 1109 described later.

In step S101, the controller 1100 detects the toner density of the developer 43 contained in the developing unit 44 based on the output signal from the inductor sensor 20.

Then, in step S102, a difference calculation unit 1101 calculates a difference ΔD between the toner density in the developer 43 contained in the developing unit 44 and a target density. The target density is output from a toner density target value determination unit 1102. Specifically, in step S102, the toner density target value determination unit 1102 determines the target density (target ratio) [wt %] of the developer 43 contained in the developing unit 44. The determination is based on ambient temperature and humidity detected by an unillustrated environment sensor disposed in the image forming apparatus.

The present exemplary embodiment employs the configuration where the toner density of the developer 43 in the developing unit 44 is detected based on the output signal from the inductor sensor 20. Alternatively, a configuration may be employed where the amount of toner accumulated in the developing unit 44 is detected based on the output signal from the inductor sensor 20. In this configuration, the toner density target value determination unit 1102 calculates the difference ΔD calculated in step S102, as a difference between the amount of toner contained in the developing unit 44 and a target amount of the toner to be contained in the developing unit 44.

In step S102, the difference calculation unit 1101 functions as a difference calculation unit (first calculation unit). The difference calculation unit calculates the difference ΔD between the toner density in the developing unit 44 detected by the inductor sensor 20 and the target density.

After the difference ΔD is calculated by the difference calculation unit 1101, a first supply amount determination unit 1104 calculates a cumulative value ΣΔD of the difference ΔD in step S103. In step S103, the first supply amount determination unit 1104 functions as a cumulative value calculation unit. The cumulative value calculation unit calculates the cumulative value ΣΔD of the difference ΔD by adding the difference ΔD calculated by the difference calculation unit 1101, every time the toner supply control processing is performed.

In toner supply control processing in a conventional image forming apparatus, a requisite amount X of toner 63 to be supplied into the developing unit 44 from the hopper 60 (FIG. 1) is calculated based on the consumption amount Tv, the difference ΔD, and the cumulative value ΣΔD of the difference ΔD. For example, the calculation is based on the following Formula (1):

$$X=Tv+(Kp\times\Delta D)+(Ki\times\Sigma\Delta D) \quad (1),$$

where coefficients Kp and Ki are gain values that are not larger than 0.

However, the conventional problem described above occurs. Specifically, the toner density in the developing unit 44 slowly drops when images requiring only a low consumption are sequentially formed, in a state where the toner density of the developer 43 accumulated in the developing unit 44 is higher than the target density (state where the ratio of the toner in the developer 43 is high). More specifically, when the images requiring only a low consumption are sequentially formed in the state where the toner density of the developer 43 accumulated in the developing unit 44 is higher than the target density, the cumulative value ΣΔD excessively increases, whereby (Kp×ΔD)+(Ki×ΣΔD)<<0 holds true. In other words, when the images requiring only a low consumption are sequentially formed in the state where the toner density of the developer 43 accumulated in the developing unit 44 is higher than the target density, the requisite amount X drops to 0 or lower, hindering the supplying of toner into the developing unit 44.

In the toner supply control processing, the toner supply for the developing unit 44 starts only after a cumulative value ΣX of the requisite amount X of toner becomes equal to or larger than a predetermined amount. Thus, in the case described above, the toner is not supplied into the developing unit 44 until the cumulative value ΣX of the requisite amount X becomes equal to or larger than the predetermined amount after the image requiring a high toner consumption is formed. Therefore, the toner might not be swiftly supplied even when the toner density in the developing unit 44 is decreasing due to the formation of the toner image requiring a high toner consumption.

When the toner images requiring a high toner consumption are sequentially formed in a state where the toner density in the developing unit 44 is lower than the target density (state where the ratio of toner in the developer 43 is low), the toner density in the developing unit 44 continues to be lower than the target density even when the toner is continuously supplied into the developing unit 44. Thus, the absolute value of the cumulative value ΣΔD of the difference ΔD increases, whereby (Kp×ΔD)+(Ki×ΣΔD)>>0 holds true. When the image forming station forms the toner image requiring only a small toner consumption, if a requisite amount X becomes excessively large after forming the toner image requiring a large toner consumption, the toner might be excessively supplied into the developing unit 44.

Thus, in the present exemplary embodiment, limit values are set for the cumulative value ΣΔD of the difference ΔD to prevent the problem described above from occurring. Specifically, an integration term (Ki×ΣΔD) for calculating the requisite amount X, is limited, whereby the toner supply to the developing unit 44 is highly accurately controlled.

In the present exemplary embodiment, upper and lower limit values are set for the cumulative value ΣΔD of the difference ΔD. Specifically, the controller 1100 sets the upper and lower limit values of the cumulative value ΣΔD of the difference ΔD, based on an average value Vave of the video count values Vn calculated from image data corresponding to the last N pages. The controller 1100 calculates the requisite amount X based on the consumption amount Tv, the difference ΔD, and the upper limit value, when the cumulative value ΣΔD exceeds the upper limit value. The controller 1100 calculates the requisite amount X based on the consumption amount Tv, the difference ΔD, and the cumulative value ΣΔD when the cumulative value ΣΔD does not exceed the upper limit value. The controller 1100 calculates the requisite amount X based on the consumption amount Tv, the difference ΔD, and the lower limit value, when the cumulative value ΣΔD is lower than the lower limit value. The controller 1100 calculates the requisite amount X based on the consumption amount Tv, the difference ΔD, and the cumulative value ΣΔD when the cumulative value ΣΔD is not smaller than the lower limit value.

A method for determining the upper and lower limit values is described below. The average video count calculation unit 1109 calculates the average video count value Vave by integrating the video count values Vn corresponding to the past N pages counted by the counter 66. In the present exemplary embodiment, the average video count calculation unit 1109 calculates the average video count value Vave based on the image data corresponding to five pages for example.

In the present exemplary embodiment, the average video count value Vprev corresponding to four pages is stored in a memory to be used (not illustrated). The average video count calculation unit 1109 reads out the average video count value Vprev from the unillustrated memory, and calculates the average video count value Vave based on the average video count value Vprev and the video count value Vn of the previously formed page.

Here, the average video count value Vprev corresponding to the past four pages is calculated by $\Sigma V_{n-1}/n-1$. In the present exemplary embodiment, a modified moving average method described in the following Formula (2) is used:

$$V_{ave}=V_N/N+V_{prev}\times(N-1)/N \quad (2),$$

where N is 5, for example, in the present exemplary embodiment. The method for calculating the average video count value Vave is not limited to the modified moving average method.

Upon receiving the average video count value Vave calculated by the average video count calculation unit 1109, a limit value calculation unit 1104*a* determines the upper and lower limit values based on the average video count value Vave in step S104. Thus, in step S104, the limit value calculation unit 1104*a* functions as a setting unit that sets the upper and lower limit values of the cumulative value ΣΔD of the difference ΔD, based on the average video count value Vave calculated from the image data corresponding to a predetermined number of pages. The limit value calculation unit 1104*a* and the first supply amount determination unit 1104 are described as separate blocks for the sake of description. Alternatively, the first supply amount determination unit 1104 may set the upper and lower values.

Figure 6:
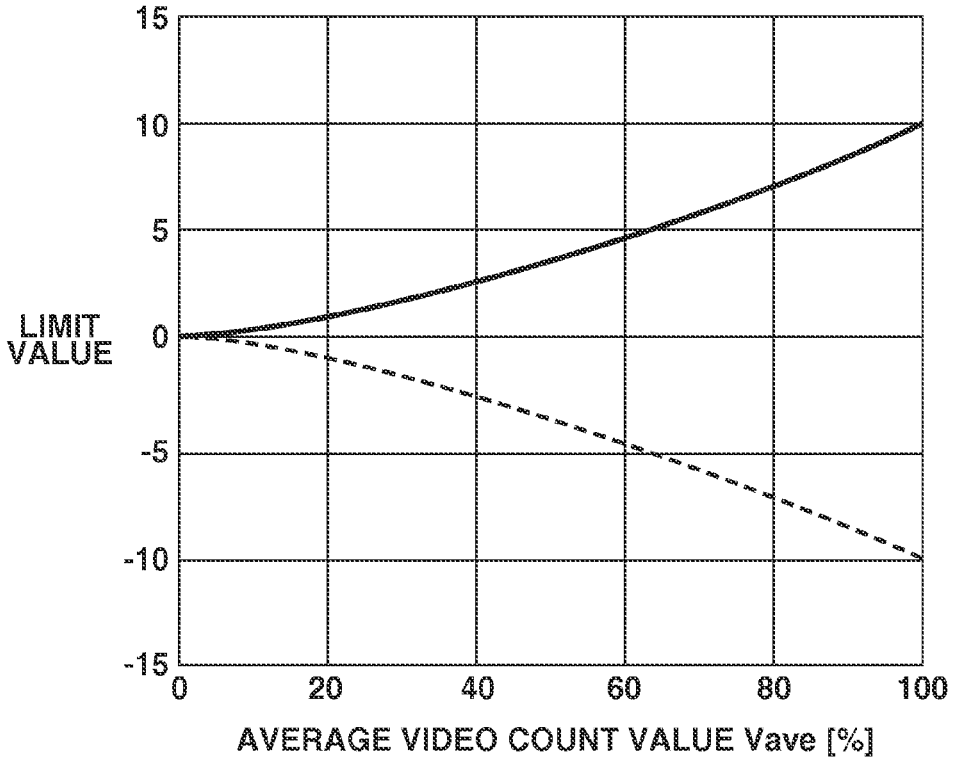
FIG. 6 is an explanatory diagram of an integration limit value in the first exemplary embodiment.

FIG. 6 is a schematic diagram illustrating a corresponding relationship between the average video count value Vave calculated based on the image data corresponding to the past five pages, and the limit values of the cumulative value ΣΔD of the difference ΔD. The video count value Vn corresponds to the number of pixels in the area on the recording material 48 in which the toner image is formed, of all the pixels included in an area determined in advance in accordance with the size of the recording material 48.

In FIG. 6, the average video count value Vave (X axis) is represented by percentages for the sake of description. Specifically, in FIG. 6, the average video count value Vave (X axis) is 100 [%] when all the images corresponding to the past five pages are solid images. The average video count value Vave is 0 [%] when all the images corresponding to the past five pages are blank images. The limit value (Y axis) is a value for limiting a cumulative value of a ratio [wt %] of the toner in the developer 43 detected by the inductor sensor 20 (the cumulative value ΣΔD of the difference ΔD). When the ratio [wt %] of the toner in the developer 43 is at a target ratio, the difference ΔD is 0.

As illustrated in FIG. 6, the absolute value of the upper and lower limit values for limiting the cumulative value ΣΔD of the difference ΔD decreases as the average video count value Vave decreases. The respective absolute values of the upper and lower limit values may not necessarily be equal to each other, and may be different from each other.

Here, a case is described where the image requiring a large toner consumption is formed after the images requiring only a small toner consumption are sequentially formed in a state where the toner density is higher than the target density. While the images requiring only a small toner consumption are being sequentially formed, the cumulative value ΣΔD of the difference ΔD is of a positive value, and thus the integration term (Ki×ΣΔD) is of a negative value, hindering the toner supply for the developing unit 44.

The absolute value of the limit value in the case where the image requiring only a small toner consumption is formed is smaller than that in the case where the image requiring a large toner consumption is formed. Thus, when the cumulative value ΣΔD of the difference ΔD exceeds the upper limit value, it is suppressed to be the upper limit value. For example, when blank images are sequentially formed, the upper and lower limit values are set to 0. In this case, the requisite amount X of toner to be supplied into the developing unit 44 is represented by X=(Kp×ΔD) because the toner consumption Tv and the integration term (Ki×ΣΔD) are both limited to 0. In the case of blank images, the requisite amount X is determined only based on the difference ΔD. This is because the toner density is lower than the target density, in addition, when blank images are printed, regardless of the cumulative value ΣΔD of the difference calculated in advance, the toner is desirably supplied immediately at the timing that the toner can be supplied.

Thus, when the toner density in the developing unit 44 drops below the target density due to the formation of the image requiring a large toner consumption, the requisite amount X obtained as a result of the calculation changes to a positive value, facilitating the toner supply to the developing unit 44. Thus, the time lag of the toner supply to the developing unit 44 after the image requiring a large toner consumption has started to be formed, can be reduced or eliminated.

Next, a case is described where the image requiring only a small toner consumption is formed after the images requiring a large toner consumption are sequentially formed in a state where the toner density is lower than the target density. While the images requiring a large toner consumption are being sequentially formed, the cumulative value ΣΔD of the difference ΔD is of a negative value, and thus the integration term (Ki×ΣΔD) is of a positive value, facilitating the toner supply to the developing unit 44.

For example, when the solid images are sequentially formed in the state where the toner density is lower than the target density, the limit value of the cumulative value ΣΔD of the difference ΔD is −10 [wt %]. Thus, the requisite amount X of the toner to be supplied into the developing unit 44 is calculated based on Formula (1) described above until the cumulative value ΣΔD of the difference ΔD drops below −10 [wt %]. Thus, the difference ΔD between the toner density in the developing unit 44 and the target value can be prevented from increasing while the images requiring a large toner consumption are formed. Further, the cumulative value ΣΔD of the difference ΔD is set to the lower limit value while the images requiring a large toner consumption are formed. Thus, excessive supply of toner into the developing unit 44 after the image requiring only a small toner consumption is formed, can be prevented.

The toner supply control processing is further described by referring back to FIG. 4. After the limit value calculation unit 1104*a* has determined the upper and lower limit values in step S104, the first supply amount determination unit 1104 determines whether the cumulative value ΣΔD of the difference ΔD exceeds the upper limit value in step S105. When the cumulative value ΣΔD of the difference ΔD exceeds the upper limit value (Yes in step S105), the first supply amount determination unit 1104 sets the cumulative value ΣΔD to the upper limit value in step S106. Then, in step S109, the first supply amount determination unit 1104 determines the requisite supply amount for correcting the difference ΔD of the toner density based on the difference ΔD and the upper limit value. In step S109, the first supply amount determination unit 1104 functions as a correction amount calculation unit that calculates the correction amount in the following manner. Specifically, a value obtained by multiplying the difference ΔD by the coefficient Kp, is added to a value obtained by multiplying the upper limit value by the coefficient Ki, when the cumulative value ΣΔD of the difference ΔD exceeds the upper limit value.

In steps S103 to S109, the first supply amount determination unit 1104 functions as a second calculation unit. The second calculation unit calculates the cumulative value ΣΔD of the difference ΔD between the toner density in the developer 43 in the developing unit 44 and the target density, and corrects the cumulative value ΣΔD of the difference ΔD based on the image data corresponding to the past five pages.

In step S110, a supply amount calculation unit 1107 calculates the requisite amount X based on the correction amount calculated by the first supply amount determination unit 1104 and the consumption amount Tv calculated by the second supply amount determination unit 1106. Specifically, in step S110, the supply amount calculation unit 1107 performs the calculation in Formula (1) described above. In other words, the supply amount calculation unit 1107 determines the requisite amount X based on the consumption amount Tv, the difference ΔD, and the upper limit value when the cumulative value ΣΔD of the difference ΔD exceeds the upper limit value (Yes in step S105).

When the cumulative value ΣΔD does not exceed the upper limit value (No in step S105), the first supply amount determination unit 1104 determines whether the cumulative value ΣΔD is smaller than the lower limit value in step S107. When the cumulative value ΣΔD of the difference ΔD is smaller than the lower limit value (Yes in step S107), the first supply amount determination unit 1104 sets the cumulative value ΣΔD to the lower limit value in step S108. Then, in step S109, the first supply amount determination unit 1104 determines the supply amount required for correcting the difference of the toner density based on the difference ΔD and the lower limit value. In step S109, the first supply amount determination unit 1104 functions as the correction amount calculation unit that calculates the correction amount in the following manner. Specifically, the value obtained by multiplying the difference ΔD by the coefficient Kp, is added to a value obtained by multiplying the lower limit value by the coefficient Ki, when the cumulative value ΣΔD of the differences ΔD is smaller than the lower limit value.

In step S110, the supply amount calculation unit 1107 calculates the requisite amount X based on the correction amount calculated by the first supply amount determination unit 1104 and the consumption amount Tv calculated by the second supply amount determination unit 1106. Specifically, the supply amount calculation unit 1107 determines the requisite amount X based on the consumption amount Tv, the difference ΔD, and the lower limit value, when the cumulative value ΣΔD of the difference ΔD is smaller than the lower limit value.

When the cumulative value ΣΔD is not smaller than the lower limit value (No in step S107), the cumulative value ΣΔD of the difference ΔD is determined to be equal to or smaller than the upper limit value and is equal to or larger than the lower limit value. In such a case, the first supply amount determination unit 1104 does not limit the cumulative value ΣΔD, and calculates the correction amount based on the difference ΔD and the cumulative value ΣΔD of the difference ΔD in step S109. Thus, in step S109, the first supply amount determination unit 1104 functions as the correction amount calculation unit that calculates the correction amount in the following manner. Specifically, the value obtained by multiplying the difference ΔD by the coefficient Kp, is added to the value obtained by multiplying the cumulative value ΣΔD by the coefficient Ki, when the cumulative value ΣΔD of the difference ΔD is equal to or smaller than the upper limit vale and equal to or larger than the lower limit value.

The supply amount calculation unit 1107 calculates the requisite amount X based on the correction amount calculated by the first supply amount determination unit 1104 and the consumption amount Tv calculated by the second supply amount determination unit 1106. Specifically, the supply amount calculation unit 1107 calculates the requisite amount X based on the consumption amount Tv, the difference ΔD, and the unlimited cumulative value ΣΔD of the difference ΔD, when the cumulative value ΣΔD of the difference ΔD is smaller than the upper limit value, or larger than the lower limit value.

After the requisite amount X is determined in step S110, a supply control unit 1108 calculates the cumulative value ΣX of the requisite amount X and determines whether the cumulative value ΣX is smaller than a predetermined amount in step S111. When the cumulative value ΣX is smaller than the predetermined amount (Yes in step S111), the toner supply control processing is terminated without supplying toner to the developing unit 44.

When the cumulative value ΣX is equal to or larger than the predetermined amount (No in step S111), the supply control unit 1108 causes the supply motor drive circuit 69 to rotate the conveyance screw 62 a single revolution, so that the toner 63 is supplied into the developing unit 44 from the hopper 60 (FIG. 1) in step S112. In step S112, the supply motor drive circuit 69 drivingly rotates the motor 70 to cause the conveyance screw 62 to rotate a single revolution in a predetermined rotation speed.

In the present exemplary embodiment, each time the motor 70 drivingly rotates the conveyance screw 62 the single revolution, an approximately constant amount of toner 63 in the hopper 60 is supplied to the developing unit 44. Thus, the supply control unit 1108 can determine the number of rotations of the conveyance screw 62, based on the cumulative value ΣX of the requisite amount of toner to be supplied into the developing unit 44. Specifically, the number of rotation of the conveyance screw 62 is two when the cumulative value ΣX is equal to or larger than a value obtained by multiplying a threshold by two and is smaller than a value obtained by multiplying the threshold by three. The number of rotation of the conveyance screw is three when the cumulative value ΣX is equal to or larger than the value obtained by multiplying the threshold by three and is smaller than a value obtained by multiplying the threshold by four. In the present exemplary embodiment, the motor 70 drivingly rotates the conveyance screw 62 in accordance with the number of rotations determined by the supply control unit 1108 while the image forming station is forming a toner image.

In the present exemplary embodiment, the minimum rotation amount of the conveyance screw 62 is a single rotation (360°). Thus, the conveyance screw 62 does not rotate unless the cumulative value ΣX of the toner 63 to be supplied into the developing unit 44 from the hopper 60 is equal to or larger than the predetermined amount. The amount of toner 63 is determined in advance through experiments, which is expected to be supplied into the developing unit 44 from the hopper 60 when the supply operation is performed once, that is, when the conveyance screw 62 is rotated a single revolution.

Then, in step S113, the supply control unit 1108 subtracts the predetermined amount from the cumulative value ΣX of the requisite amount X of the toner 63 to be supplied into the developing unit 44 from the hopper 60, and the processing proceeds to step S111. In the processing in steps S111 to S113, the supply control unit 1108 causes the motor 70 to drivingly rotate the conveyance screw 62 until the cumulative value ΣX of the requisite amount of the toner to be supplied into the developing unit 44 from the hopper 60 drops below the predetermined amount. The toner supply control processing in the present exemplary embodiment is as described above.

(Comparison of Effect)

Figure 7:
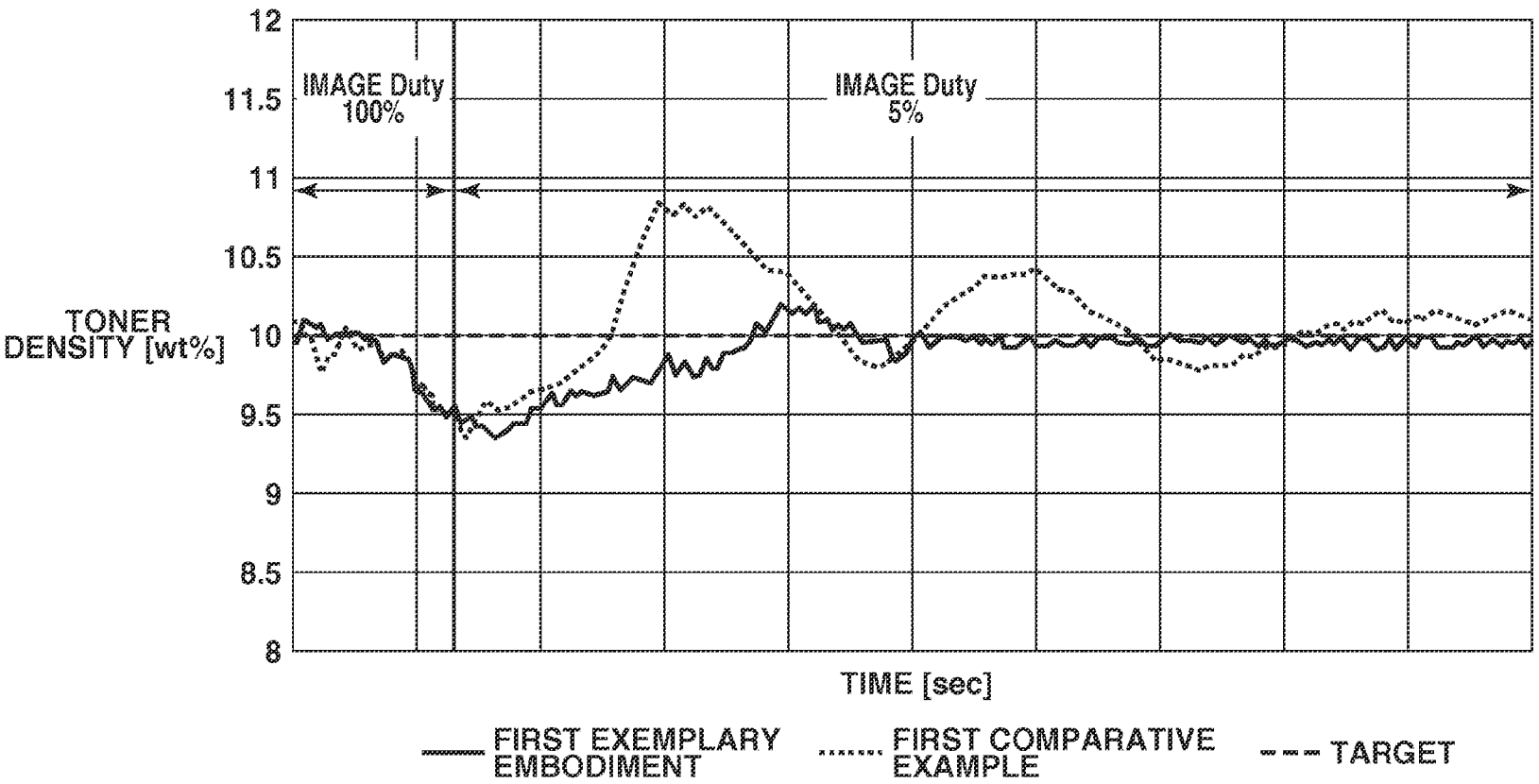
FIG. 7 is a transition diagram illustrating transitions of a toner density in the first exemplary embodiment and a comparative example.

Transitions of the toner density within the developing unit 44 in the toner supply control processing in the present exemplary embodiment and in toner supply control processing in a comparative example, are described based on FIG. 7.

FIG. 7 illustrates results of detecting the toner density based on the output signal from the inductor sensor 20 in an exemplary case. In the exemplary case, 100 pages of images of the image Duty 5 [%] are sequentially formed after 10 pages of images of the image Duty 100 [%] (solid images) are sequentially formed. The solid line (the present exemplary embodiment) represents the transition of the toner density within the developing unit 44 in the case where the cumulative value ΣΔD of the difference ΔD is limited based on the limit value. A dashed line of shorter dots (first comparative example) represents the transition of the toner density within the developing unit 44 in the case where the cumulative value ΣΔD of the difference ΔD is unlimited.

As illustrated in FIG. 7, when the cumulative value ΣΔD of the difference ΔD is unlimited (first comparative example), the image of the image Duty 5 [%] (small toner consumption) is formed in a state where the toner density of the developer 43 contained in the developing unit 44 is low. Thus, the cumulative value ΣΔD of the difference ΔD is 0 or less. Thus, the requisite amount X of the toner to be supplied into the developing unit 44 becomes excessively large, causing an acute rise in the toner density while the image of the image Duty 5 [%] (small toner consumption) is being formed, which in turn leads to overshooting.

When the cumulative value ΣΔD of the difference ΔD is limited (the present exemplary embodiment), the image of the image Duty 5 [%] (small toner consumption) is formed in the state where the toner density of the developer 43 contained in the developing unit 44 is low, with the cumulative value ΣΔD of the difference ΔD limited. Thus, the requisite amount X of the toner to be supplied into the developing unit 44 is prevented from being excessively large. Thus, the acute rise in the toner density while the image of the image Duty 5 [%] is being formed is prevented.

Thus, in the present exemplary embodiment, the cumulative value ΣΔD is suppressed based on the average video count value Vave even when the image requiring a large toner consumption is formed after a plurality of images requiring only a small toner consumption is sequentially formed. Thus, the variation of the densities of the images formed by the image forming apparatus, can be reduced or eliminated. In other words, in the present exemplary embodiment, even when the density of the image formed by the image forming station suddenly changes, the toner density of the developer 43 in the developing unit 44 can be adjusted to the target density with high accuracy.

In the first exemplary embodiment, the limit value calculation unit 1104*a* determines the limit values based on the average video count value Vave calculated by the average video count calculation unit 1109. However, the configuration for determining the limit value is not limited to this. For example, a service man may manually set the limit values by using the operation unit 501. In this configuration, the controller 1100 stores limit value information input through the operation unit 501, in an unillustrated memory. The first supply amount determination unit 1104 may limit the integral section based on the limit value information stored in the memory. Here, the operation unit 501 functions as an acquisition unit that acquires the limit value information.

In the first exemplary embodiment, both the upper and lower limit values are set. Alternatively, a configuration may be employed where at least one of the upper and lower limit values is set. For example, the limit value calculation unit 1104*a* may set the lower limit value of the cumulative value ΣΔD of the difference ΔD when the average video count value Vave is larger than a threshold set in advance. Alternatively, the limit value calculation unit 1104*a* may set the upper limit value of the cumulative value ΣΔD of the difference ΔD when the average video count value Vave is smaller than the threshold set in advance.

A second exemplary embodiment is described below. In the first exemplary embodiment, the cumulative value ΣΔD of the difference ΔD between the toner density of the developer 43 contained in the developing unit 44 and the target density is limited. Thus, the influence of the integral term is limited when the requisite amount X is calculated. In the present exemplary embodiment, the coefficient Ki in the integral term is determined based on the image data corresponding to the past N pages. Also in the present exemplary embodiment, the influence of the integral term can be limited when the requisite amount is calculated, as in the first exemplary embodiment.

The present exemplary embodiment is different from the first exemplary embodiment described above in the following point while other points in the present exemplary embodiment are the same as the counterparts in the first exemplary embodiment, and thus will not be described. The toner supply control processing in the present exemplary embodiment is described below based on FIGS. 8 to 11.

Figure 8:
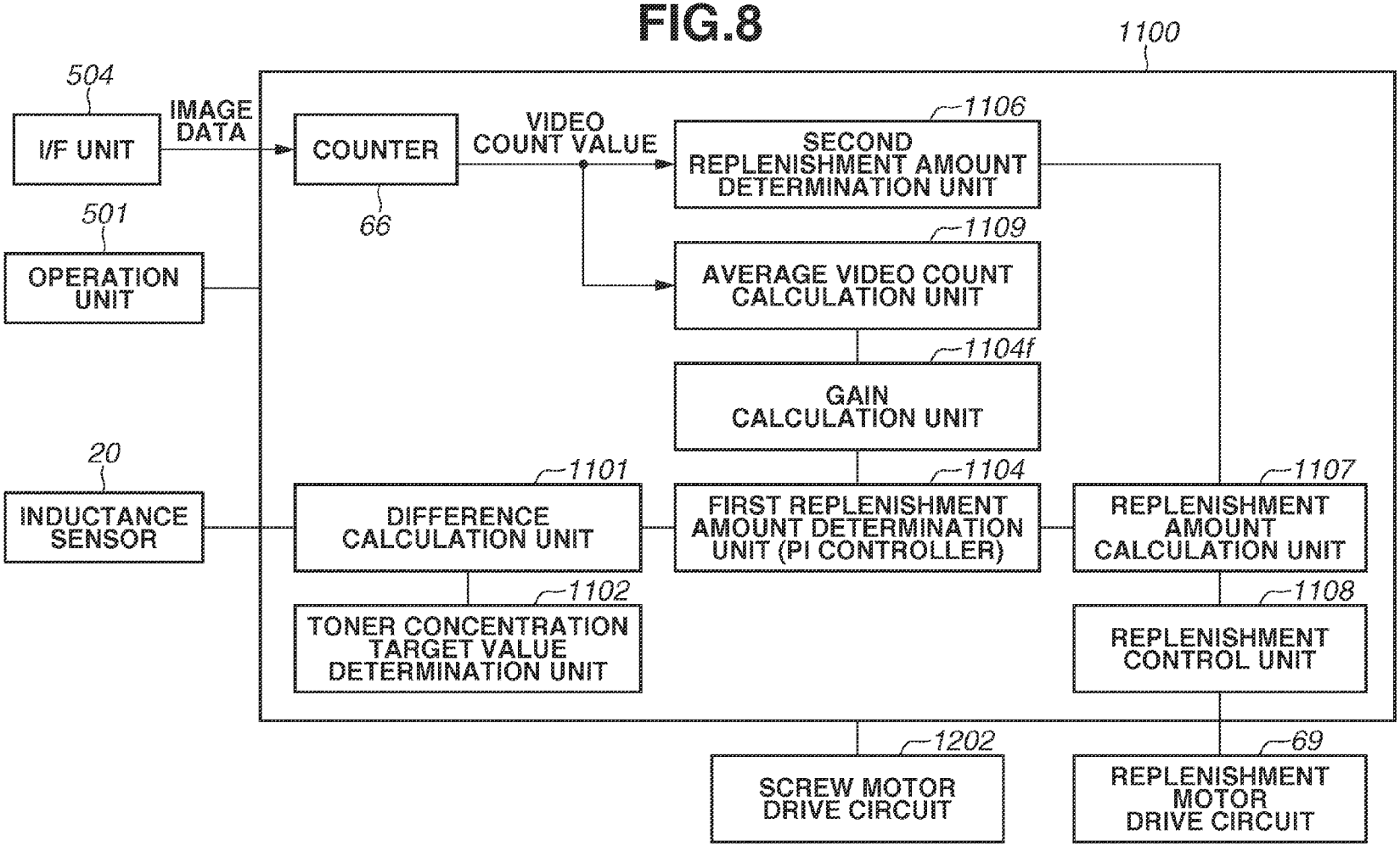
FIG. 8 is a block diagram illustrating an electrical configuration related to toner supply in a second exemplary embodiment.

FIG. 8 is a block diagram illustrating an electrical configuration related to toner supply of the image forming apparatus. In the first exemplary embodiment, the limit value calculation unit 1104*a* (FIG. 3) sets the limit values based on the average video count value Vave. In the present exemplary embodiment, a gain calculation unit 1104*f* sets a value of the coefficient Ki.

The gain calculation unit 1104*f* refers to a conversion graph (FIG. 10) stored in an unillustrated memory in advance to determine the coefficient Ki based on the average video count value Vave calculated by the average video count calculation unit 1109. In the present exemplary embodiment, for example, the coefficient Ki is set to −0.1 when the average video count value Vave is 100[%]. The coefficient Ki is set to 0 when the average video count value Vave is 0[%]. When the toner density in the developing unit 44 is lower than the target density, the coefficient Ki is set to a value that is equal to or less than 0, whereby the requisite amount X calculated based on Formula (1) described above is of a positive value.

Figure 10:
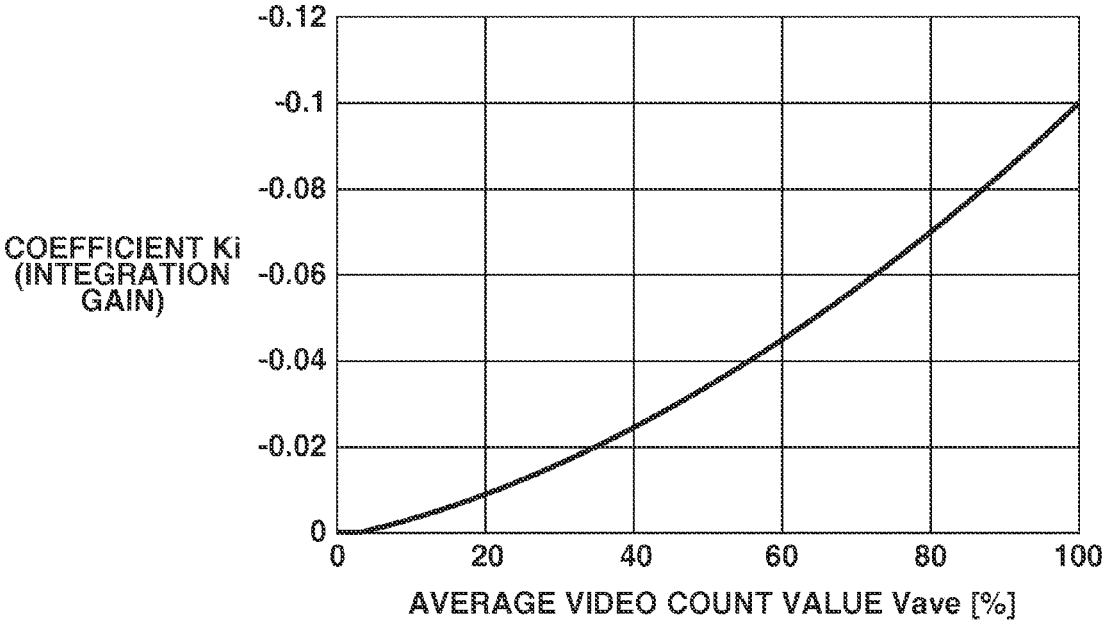
FIG. 10 is an explanatory diagram of an integration limit value in the second exemplary embodiment.

FIG. 10 is an explanatory diagram of the conversion graph involving the average video count value Vave and the coefficient Ki (integration gain). The absolute value of coefficient Ki (integration gain) increases as the average video count value Vave increases. Thus, when the images requiring only a small toner consumption are sequentially formed, the average video count value Vave decreases, and thus the value of the integration term is suppressed.

Figure 9:
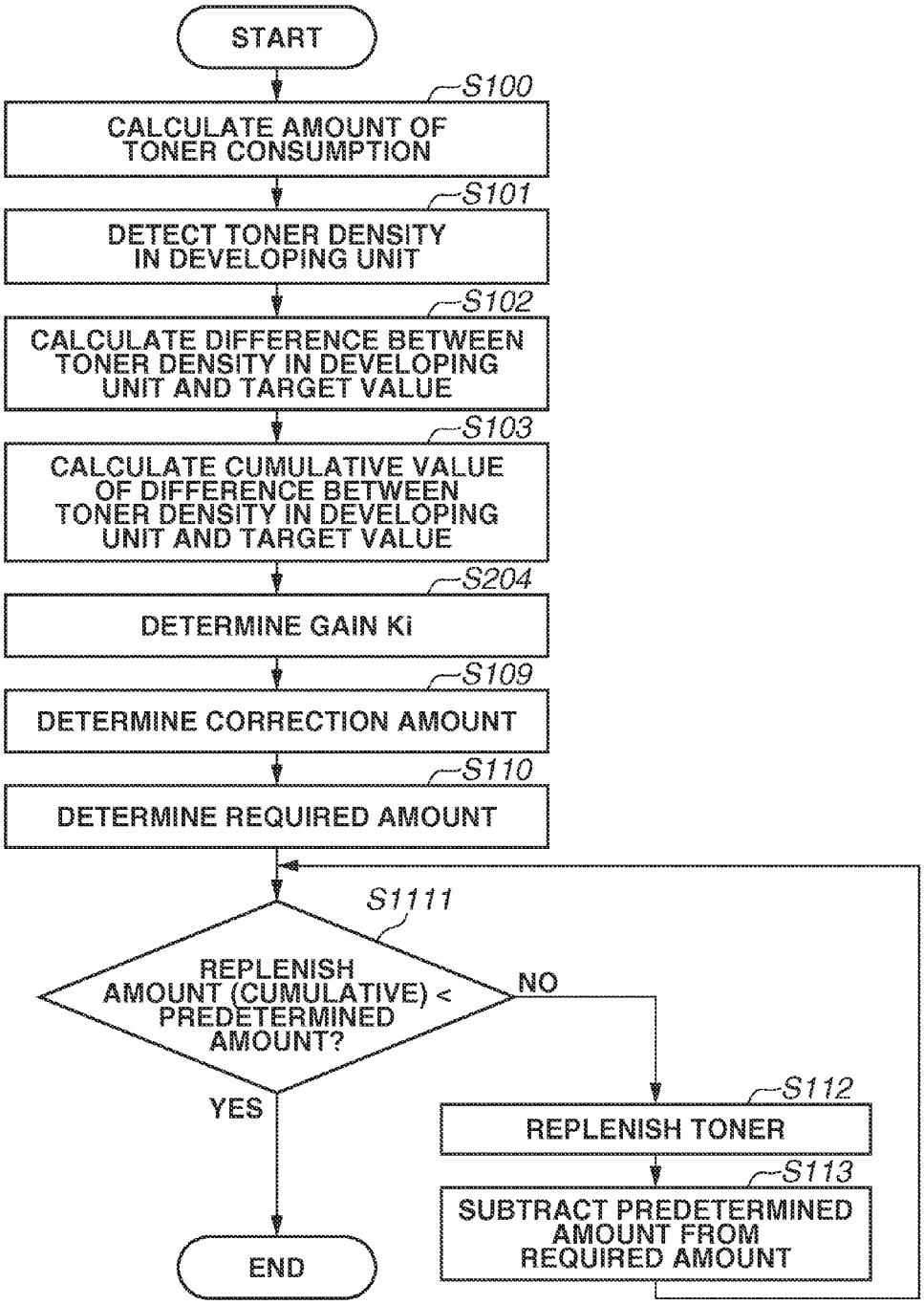
FIG. 9 is a flowchart illustrating toner supply control processing in the second exemplary embodiment.

The toner supply control processing in the present exemplary embodiment will be described below based on FIG. 9. FIG. 9 is a flowchart illustrating operations of the controller 1100.

The processing in steps S100 to S103 is the same as that in the first exemplary embodiment, and thus will not be described herein.

In step S103, the first supply amount determination unit 1104 calculates the cumulative value ΣΔD of the difference ΔD by adding the difference ΔD calculated by the difference calculation unit 1101, every time the toner supply control processing is performed.

Upon receiving the average video count value Vave calculated by the average video count calculation unit 1109, the gain calculation unit 1104*f* determines the coefficient Ki based on the average video count value Vave in step S204. In step S204, the gain calculation unit 1104*f* functions as a correction unit that changes the coefficient Ki based on the image data corresponding to the past five pages. The gain calculation unit 1104*f* and the first supply amount determination unit 1104 are described as separate blocks for the sake of description. Alternatively, the first supply amount determination unit 1104 may set the coefficient Ki.

The first supply amount determination unit 1104 calculates a correction amount, that is, a supply amount required for correcting the difference of the toner density in step S110 in the following manner. Specifically, the value obtained by multiplying the difference ΔD by the coefficient Kp, is added to the value obtained by multiplying the cumulative value ΣΔD of the difference ΔD by the coefficient Ki. The processing in step S111 and after is also the same as that in the first exemplary embodiment, and thus will not be described herein.

(Comparison of Effect)

Figure 11:
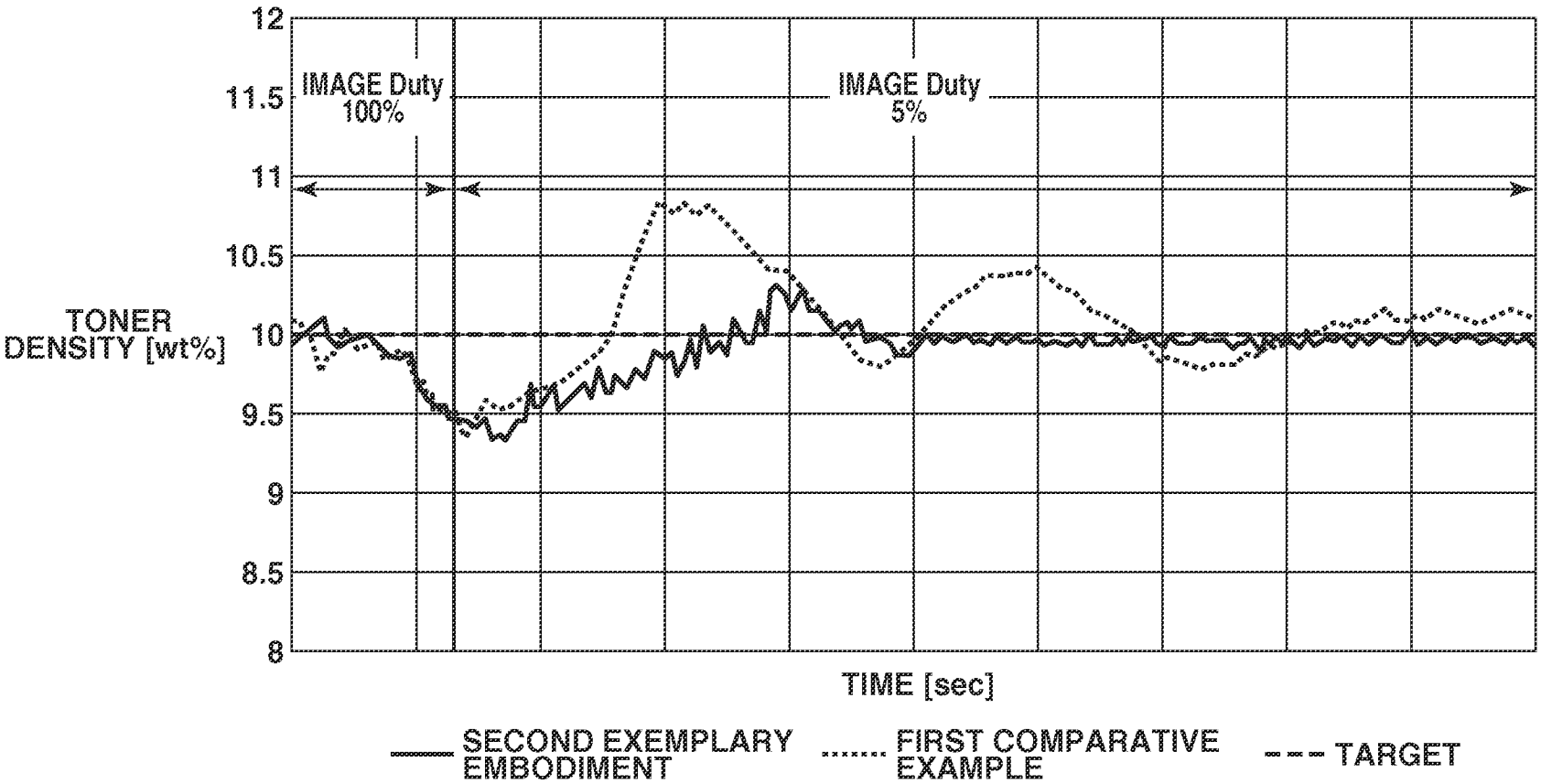
FIG. 11 is a transition diagram illustrating transitions of a toner density in the second exemplary embodiment and the comparative example.

Transitions of the toner density within the developing unit 44 in the toner supply control processing in the present exemplary embodiment and in toner supply control processing in the comparative example, are described based on FIG. 11.

FIG. 11 illustrates results of detecting the toner density based on the output signal from the inductor sensor 20 in an exemplary case. In the exemplary case, 100 pages of images of image Duty 5 [%] are sequentially formed after 10 pages of images of image Duty 100 [%] (solid shaded images) are sequentially formed. The solid line (the present exemplary embodiment) represents the transition of the toner density within the developing unit 44 in the case where the coefficient Ki is set based on the average video count value Vave. A dashed line with shorter dots (first comparative example) represents the transition of the toner density within the developing unit 44 in the case where the coefficient Ki is a fixed value.

As illustrated in FIG. 11, when the coefficient Ki is a fixed value (first comparative example), the image of the image Duty 5 [%] (small toner consumption) is formed in a state where the toner density of the developer 43 contained in the developing unit 44 is low. Therefore, the integration term (Ki×ΣΔD) becomes large. Thus, the requisite amount X of the toner to be supplied into the developing unit 44 becomes excessively large, causing an acute rise in the toner density while the image of the image Duty 5 [%] (small toner consumption) is being formed, which in turn leads to overshooting.

On the other hand, when the coefficient Ki is changeable in accordance with the average video count value Vave (the present exemplary embodiment), the image of the image Duty 5 [%] (small toner consumption) is formed in the state where the toner density of the developer 43 contained in the developing unit 44 is low with the low integration gain Ki, and thus (Ki×ΣΔD) is suppressed. Therefore, the requisite amount X of the toner to be supplied into the developing unit 44 is prevented from being excessively large. Thus, the acute rise in the toner density while the image of the image Duty 5 [%] is formed is prevented.

Thus, in the present exemplary embodiment, the integration term (Ki×ΣΔD) is suppressed based on the average video count value Vave even when the image requiring a large toner consumption is formed after a plurality of images requiring only a small toner consumption is sequentially formed. Thus, the variation of the densities of the images formed by the image forming apparatus, can be reduced or eliminated. In other words, in the present exemplary embodiment, even when the density of the image formed by the image forming station suddenly changes, the toner density of the developer 43 in the developing unit 44 can be adjusted to the target density with high accuracy.

The first and the second exemplary embodiments both employ the configuration where the controller 1100 performs the toner supply control processing every time the image forming station forms an image corresponding to a single page of the recording material 48. The timing at which the controller 1100 performs the toner supply control processing is not limited to this configuration. For example, the controller 1100 may perform the toner supply control processing in a predetermined time period while the agitation screws 58 and 59 that agitate the toner accumulated in the developing unit 44 rotates. In this configuration, the toner 63 can be supplied into the developing unit 44 from the hopper 60 also when the image forming station is not forming the toner image.

The first and the second exemplary embodiments both employ the configuration where the conveyance screw is rotated a single revolution at a time until the requisite amount X of toner drops below the predetermined amount. Alternatively, the supply control unit 1108 may calculate the number of revolutions of the conveyance screw 62 based on the requisite amount X, and the supply motor drive circuit 69 is controlled in such a manner that the conveyance screw 62 is rotated by the number of revolutions thus calculated.

The first and the second exemplary embodiments both employ the configuration where the toner 63 is supplied into the developing unit 44 from the hopper 60 by the rotation of the conveyance screw 62. However, the configuration for supplying the toner 63 into the developing unit 44 is not limited to this. For example, the toner may be supplied by using a container that directly supplies the toner contained within the container, into the developing unit 44. In this configuration, the supply control unit 1108 may use the supply motor drive circuit 69 to control the speed and the number of rotations for drivingly rotating the container.

While the present disclosure has been described with reference to exemplary embodiments, it is to be understood that these exemplary embodiments are not seen to be limiting. The scope of the following claims is to be accorded the broadest interpretation so as to encompass all such modifications and equivalent structures and functions.

This application claims the benefit of Japanese Patent Application No. 2013-260379 filed Dec. 17, 2013, which is hereby incorporated by reference herein in its entirety.

What is claimed is:

1. An image forming apparatus comprising:

an image forming unit including a containing unit configured to contain a developer including toner, and configured to form an image based on image data by using the toner contained in the containing unit;

a supply unit configured to supply the toner into the containing unit;

a consumption amount calculation unit configured to calculate, based on information related to a density of an image corresponding to the image data, a consumption amount of the toner consumed in the containing unit in a case where the image forming unit forms the image;

a detection unit configured to detect a toner density of the developer contained in the containing unit;

a correction amount calculation unit configured to calculate, based on the information related to the density of the image corresponding to the image data and the toner density detected by the detection unit, a correction amount by which the consumption amount calculated by the consumption amount calculation unit is corrected; and a controller configured to control the supply unit based on the consumption amount calculated by the consumption amount calculation unit and the correction amount calculated by the correction amount calculation unit, wherein the correction amount calculation unit includes:

a first calculation unit configured to calculate a difference between the toner density detected by the detection unit and a target value of the toner density of the developer contained in the containing unit, and a second calculation unit configured to calculate a cumulative value of the difference calculated by the first calculation unit and correct the cumulative value of the difference based on the information related to the density of the image corresponding to the image data, wherein the correction amount calculation unit calculates the correction amount based on the difference calculated by the first calculation unit and the cumulative value of the difference corrected by the second calculation unit.

2. The image forming apparatus according to claim 1, wherein the second calculation unit includes a correction unit configured to correct the cumulative value of the difference by multiplying the cumulative value of the difference by a coefficient, and wherein the correction unit is configured to change the coefficient based on the information related to the density of the image corresponding to the image data.

3. The image forming apparatus according to claim 2, wherein the correction unit is configured to change the coefficient based on the information related to the density of the image corresponding to each image data in toner image formation for a predetermined number of pages performed by the image forming unit.

4. The image forming apparatus according to claim 1, wherein the correction amount calculation unit further includes a setting unit configured to set at least one of an upper limit value of the cumulative value of the difference and a lower limit value of the cumulative value of the difference, based on the information related to the density of the image corresponding to the image data, and wherein the correction amount calculation unit is configured to calculate the correction amount based on the difference, the cumulative value of the difference, and at least one of the upper limit value of the cumulative value of the difference and the lower limit value of the cumulative value of the difference set by the setting unit.

5. The image forming apparatus according to claim 4, wherein the setting unit is configured to set at least one of the upper limit value of the cumulative value of the difference and the lower limit value of the cumulative value of the difference based on the information related to the density of the image corresponding to each image data in toner image formation for a predetermined number of pages performed by the image forming unit.

6. The image forming apparatus according to claim 4, wherein the setting unit is configured to set the upper limit value based on the information about the density of the image corresponding to the image data when the cumulative value of the difference is greater than a threshold.

7. The image forming apparatus according to claim 4, wherein the correction amount calculation unit is configured to calculate the correction amount based on the difference and the upper limit value when the cumulative value of the difference is greater than the upper limit value, and wherein the correction amount calculation unit is configured to calculate the correction amount based on the difference and the cumulative value of the difference when the cumulative value of the difference is less than the upper limit value.

8. The image forming apparatus according to claim 4, wherein the setting unit is configured to set the lower limit value based on the information about the density of the image corresponding to the image data when the cumulative value of the difference is less than a threshold.

9. The image forming apparatus according to claim 4, wherein the correction amount calculation unit is configured to calculate the correction amount based on the difference and the lower limit value when the cumulative value of the difference is less than the lower limit value, and wherein the correction amount calculation unit is configured to calculate the correction amount based on the difference and the cumulative value of the difference when the cumulative value of the difference is greater than the lower limit value.

10. The image forming apparatus according to claim 1, wherein the controller includes a determination unit configured to determine, based on the consumption amount and the correction amount, an amount of the toner to be supplied into the containing unit, and wherein the controller controls the supply unit based on the amount of the toner to be supplied into the containing unit determined by the determination unit.

11. The image forming apparatus according to claim 10, wherein the controller accumulates the amount of the toner to be supplied that is determined by the determination unit, to obtain a cumulative value of the amount, and causes the supply unit to supply toner into the containing unit when the cumulative value of the amount of the toner to be supplied exceeds a threshold.

12. The image forming apparatus according to claim 10, wherein the supply unit is configured to rotate a container containing toner to supply the toner into the containing unit from the container, wherein the controller is configured to determine a number of rotations by which the container is rotated, based on the amount of the toner to be supplied which is determined by the determination unit, and wherein the supply unit is configured to rotate the container based on the number of rotations determined by the controller.

13. The image forming apparatus according to claim 10, wherein the determination unit is configured to determine the amount of the toner to be supplied every time a toner image corresponding to a single page of a recording material is formed by the image forming unit.

14. The image forming apparatus according to claim 1, wherein the containing unit includes an agitation unit configured to agitate the developer contained in the containing unit, and wherein the determination unit is configured to determine the amount of the toner to be supplied in a predetermined time period while the agitation unit agitates the developer.

15. An image forming apparatus comprising:

an image forming unit including a containing unit configured to contain a developer including toner, and configured to form an image based on image data by using the toner contained in the containing unit;

a supply unit configured to supply the toner into the containing unit;

a consumption amount calculation unit configured to calculate, based on information related to a density of an image corresponding to the image data, a consumption amount of the toner consumed in the containing unit in a case where the image forming unit forms the image;

a detection unit configured to detect a toner density of the developer contained in the containing unit;

a difference calculation unit configured to calculate a difference between the toner density detected by the detection unit and a target value of the toner density of the developer contained in the containing unit;

a cumulative value calculation unit configured to calculate a cumulative value of the difference calculated by the difference calculation unit;

a setting unit configured to set at least one of an upper limit value of the cumulative value of the difference and a lower limit value of the cumulative value of the difference; and a controller configured to control the supply unit based on the consumption amount calculated by the consumption amount calculation unit, the difference calculated by the difference calculation unit, the cumulative value of the difference calculated by the cumulative value calculation unit, and at least one of the upper limit value and the lower limit value set by the setting unit.

16. The image forming apparatus according to claim 15, wherein the setting unit is configured to set at least one of the upper limit value of the cumulative value of the difference and the lower limit value of the cumulative value of the difference based on information related to a density of an image corresponding to each image data in toner image formation for a predetermined number of pages performed by the image forming unit.

17. The image forming apparatus according to claim 15, further comprising an acquisition unit configured to acquire limit value information for limiting the cumulative value of the difference, wherein the setting unit sets at least one of the upper limit value of the cumulative value of the difference and the lower limit value of the cumulative value of the difference based on the limit value information acquired by the acquisition unit.

18. A method for controlling an image forming apparatus including an image forming unit including a containing unit configured to contain a developer including toner, and configured to form an image based on image data by using the toner contained in the containing unit, a supply unit configured to supply the toner into the containing unit, and a detection unit configured to detect a toner density of the developer contained in the containing unit, the method comprising:

determining a consumption amount of the toner consumed in the containing unit when the image forming unit forms the image;

calculating a difference between the toner density detected by the detection unit and a target value of the toner density of the developer contained in the containing unit;

calculating a cumulative value of the difference;

determining at least one of an upper limit value of the cumulative value of the difference and a lower limit value of the cumulative value of the difference; and controlling the supply unit based on the consumption amount, the difference, the cumulative value of the difference, and at least one of the upper limit value and the lower limit value.

* * * * *